United States Patent [19]

Herfeld

[11] Patent Number: 4,918,665

[45] Date of Patent: Apr. 17, 1990

[54] APPARATUS FOR MIXING MATERIAL

[76] Inventor: Friedrich W. Herfeld, Wall 1, 5983 Neuenrade, Fed. Rep. of Germany

[21] Appl. No.: 16,723

[22] PCT Filed: May 30, 1986

[86] PCT No.: PCT/EP86/00324

§ 371 Date: Jan. 27, 1987

§ 102(e) Date: Jan. 27, 1987

[87] PCT Pub. No.: WO86/07286

PCT Pub. Date: Dec. 18, 1986

[30] Foreign Application Priority Data

Jun. 4, 1985 [DE] Fed. Rep. of Germany ..... 3520040

[51] Int. Cl.[4] ..... B01F 7/00

[52] U.S. Cl. ..... 366/294; 366/295; 366/296; 366/66; 241/98; 475/253

[58] Field of Search ..... 241/46.06, 46.11, 98; 74/750 R, 714, 394; 366/279, 282, 283, 286, 292, 293, 287, 294, 295, 296, 205, 314, 65, 66, 64, 281

[56] References Cited

U.S. PATENT DOCUMENTS

| | | | |
|---|---|---|---|
| 1,425,678 | 8/1922 | Newhouse | 74/750 R |
| 2,161,604 | 6/1939 | Watts | 74/394 |
| 2,182,285 | 12/1939 | DeCaria | 74/750 R |
| 2,209,287 | 7/1940 | Simpson | 366/296 |
| 2,458,706 | 1/1949 | Howe | 74/750 R |
| 2,846,895 | 8/1958 | Severin | 74/394 |
| 4,019,722 | 4/1977 | Shohet | 366/294 X |
| 4,057,226 | 11/1977 | deMos | 366/287 X |
| 4,403,868 | 9/1983 | Kupka | 366/296 X |

FOREIGN PATENT DOCUMENTS 1210325 3/1960 France .

*Primary Examiner*—Harvey C. Hornsby
*Assistant Examiner*—K. O'Leary
*Attorney, Agent, or Firm*—Learman & McCulloch

[57] ABSTRACT

The invention relates to mixing apparatus in which the drive motor and the stirrers are each coupled to the three revolving elements of a planetary gear. In such apparatus the speed of the two stirrers is automatically adapted to the prevailing counter-moment.

20 Claims, 5 Drawing Sheets

APPARATUS FOR MIXING MATERIAL

The invention relates to mixing apparatus of the kind having two coaxial stirrers and a common motor for driving them.

Apparatus of the general class to which the invention relates is known for example from U.S. Pat. No. 2,209,287. In that apparatus, one stirrer is coupled directly to the drive motor, whilst the other stirrer is driven via the inner gear ring of a planetary gear in which the sun wheel is coupled to the drive shaft and the planet carrier is fixed stationary on the housing of the mixing apparatus. Consequently the two stirrers are driven at a fixed spaced and a constant speed ratio.

The disadvantage of such a construction is that when one stirrer has to overcome a particularly great moment of resistance, and in an extreme case comes to a standstill, the other stirrer is also incapable of exerting a stirring effect.

The object of the invention, therefore, is to provide dual stirrer mixing apparatus wherein the two stirrers operate in an optimum manner even with differing and alternating moments of resistance.

In the mixing apparatus according to the invention the speeds of the stirrers are not fixed in advance but are automatically set as a function of the counter-moment of the stirrers. If the counter-moments (i.e. the moments of resistance exerted on the stirrers by the material to be mixed) alter, then the speeds of the stirrers are also altered so that the stirrer encountering the least resistance rotates at an increased speed that is higher than its initial speed. If in an extreme case one stirrer is brought to a standstill by an unusually great moment of resistance then the other stirrer goes at maximum speed.

If the external diameter and/or the tool cross-section of one stirrer is chosen so as to be greater than the external diameter and/or tool cross-section of the other stirrer, then basically the first stirrer runs more slowly than the second stirrer. Furthermore, the speed of each of the two stirrers is adapted to the moment of resistance in each case.

The mixing tool according to the invention is also distinguished by an optimum mixing effect even with material which is difficult to mix, and also by low energy consumption and compact construction.

The invention is explained in greater detail below with the aid of several embodiments which are illustrated in the drawings wherein.

Figure 1:
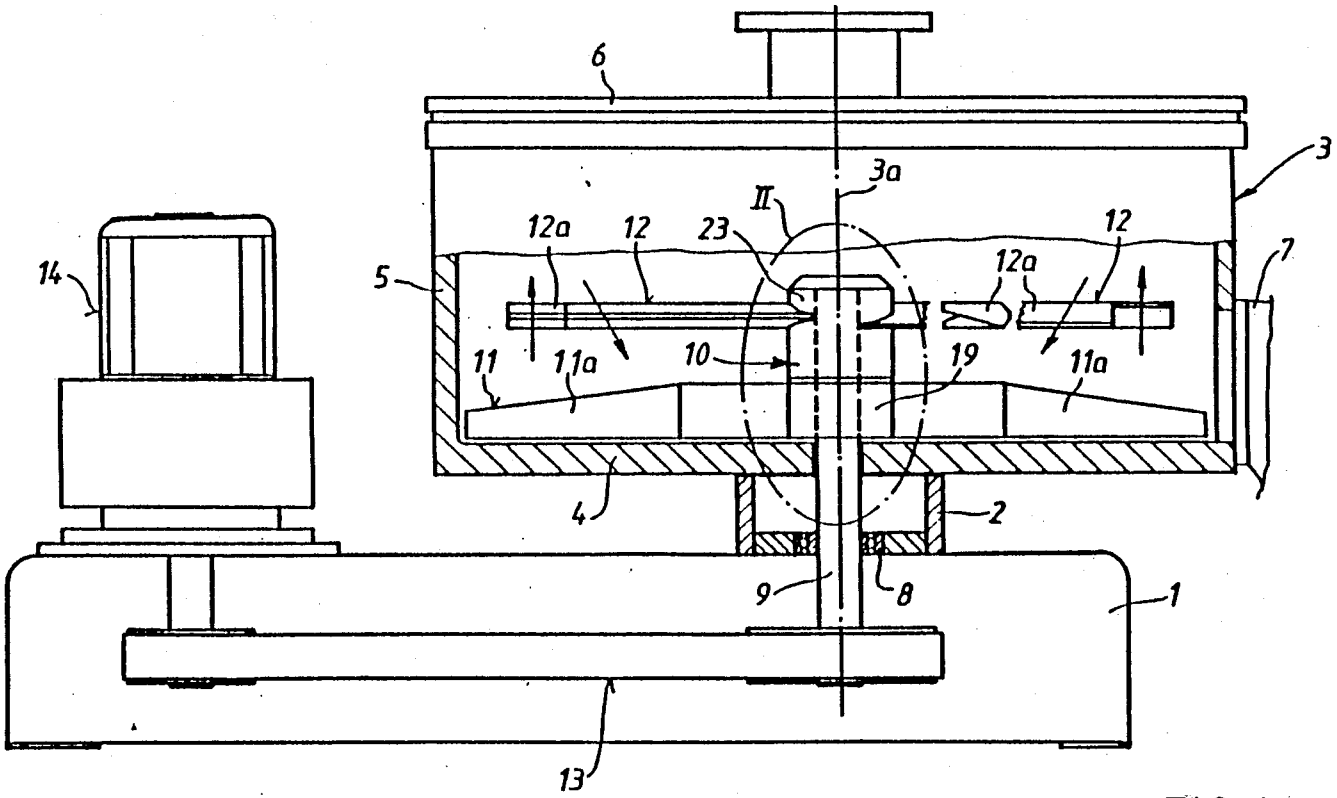
FIG. 1 shows a partially cut-away overall view of the mixing apparatus according to the invention.

First of all the general construction of the mixing apparatus will be described with the aid of FIG. 1. This mixinng apparatus is built on a stand 1 on which is arranged a pillar or column 2 supporting a mixing vessel 3 which is constructed as a cylindrical vessel with a vertical axis 3a. The base 4 and the peripheral wall 5 of this mixing vessel 3 can be of double-walled construction and can have a heat exchange medium (e.g. cooling medium) flowing through them. A cover 6 closes off the mixing vessel 3 towards the top, whilst a discharge pipe 7 or the like serves for the discharge of the mixed material.

The drive shaft 9 of a planetary gear 10 which will be described in greater detail below is supported and guided in at least one roller bearing 8 inside the support 2. The planetary gear serves for the common rotary drive of a lower stirrer 11 which is arranged near the base inside the mixing vessel 3 and an upper stirrer 12 which is arranged axially spaced above the stirrer 11.

In this embodiment at least two blades 11a having the same cross-section and the same radial length are provided as stirrer tools for the lower stirrer, and at least two blades 12a having the same length and the same cross-section are also provided as stirrer tools for the upper stirrer.

Whilst the upper end of the gear drive shaft 9 is coupled to the planetary gear 10, the lower end of this drive shaft 9 is coupled via a belt drive 13 to a drive motor 14 which, depending upon the use for which the mixing apparatus is intended, can be a drive motor with a constant speed or a drive motor with variable speed (e.g. a vario gear drive).

In this mixing apparatus the two stirrers 11 and 12 which are arranged one above the other are intended to be driven by the planetary gear 10 at selected different or relative speeds of rotation. For this purpose it is important first of all for the external diameter and/or the blade cross-section of the slower-running stirrer to be chosen so as to be greater than the external diameter and/or blade cross-section of the faster-running stirrer.

In the embodiment illustrated in FIG. 1 it is assumed that the lower stirrer 11 is the slow-running one and the upper stirrer 12 is the fast-running one. It can therefore be seen in the drawing that the lower stirrer 11 has the greater external diameter, i.e. the radially outer ends of the blades 11a extend to the immediate proximity of the inner face of the peripheral wall 5, whilst the external diameter of the upper stirrer 12 is kept substantially smaller than that of the lower stirrer 11. In addition, the blades 12a of the upper stirrer 12 (as indicated on the right-hand blades 12a in FIG. 1) have a smaller cross-section than the blades 11a of the lower stirrer 11; at least the blades 12a of the faster-running stirrer 12 preferably have a fairly streamlined cross-section.

In the embodiment described above of the two stirrers 11, 12 which lie one above the other, a greater counter-moment acts on the lower stirrer 11 or the blades 11a thereof during the mixing operation than on the upper stirrer 12 or the blades 12a thereof.

A first embodiment of the planetary gear which drives the two stirrers 11 and 12 will now be described with the aid of FIG. 2.

The planetary gear 10 contains a sun wheel 15 which is fixed (e.g. wedged) on the upper end 9a of the transmission shaft 9, an inner gear ring 16 which is arranged coaxially therewith, at least two planet wheels 17 positioned in the annular space between the sun wheel 15 and the inner gear ring 16 and in toothed engagement with both of the latter, and a planet carrier 18 which retains these planet wheels 17 so that they are freely rotatable.

In this embodiment the lower stirrer 11 has a lower hub 19 which is of hollow construction and projects downwards with its lower end through the vessel base 4 and is mounted in this vessel base—suitably sealed—by means of roller bearings 20 so as to be freely rotatable. The lower end section 19*a* of this lower hub 19 which projects out of the vessel base 4 is widened in the shape of a bell, and the inner gear ring 16 of the planetary gear 10 is fixed in this lower end section 19*a*. Thus the bell-mouthed lower end section 19*a* of the lower hub 19 surrounds the sun wheel 15, the planet wheels 17 and the planet carrier 18 advantageously in the manner of a housing.

The planet carrier 18 which is for example of annular or circular construction and bears the planet wheels 17 so that they are freely rotatable has a shaft 21 which is connected to it so as to be fixed against rotation and extends coaxially upwards through the hollow lower hub 19, is supported and guided in this lower hub 19 by roller bearings 22 so as to be freely rotatable and is connected with its upper end 21*a* to the upper hub 23 of the upper stirrer 12 so as to be fixed against rotation (e.g. screwed or wedged on).

Figure 3:
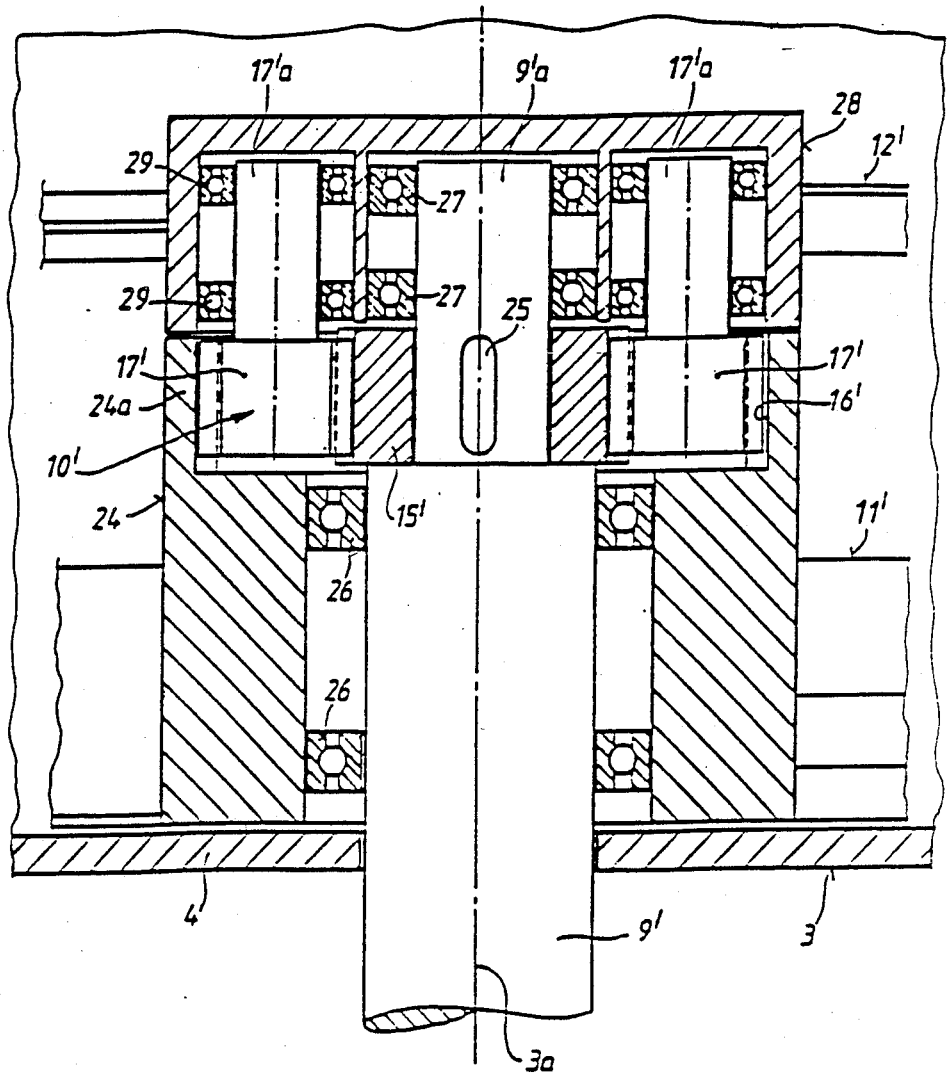
FIG. 3 shows a sectional view of a detail similar to that of FIG. 2, but to explain a second embodiment.

A second embodiment of the planetary gear 10' is illustrated in FIG. 3; for the sake of simplicity, in this second embodiment parts and elements which are of similar construction are designated by the same reference numerals modified by prime, so detailed explanation thereof is unnecessary.

In this embodiment as shown in FIG. 3 the lower hub 24 of the lower stirrer 11' is of hollow construction and is provided at one end, in this case at its upper end 24*a*, with an inner gear ring 16' fixed in it, and in addition to this inner gear ring 16' the planetary gear 10' contains a sun wheel 15' which is fixed on the upper end 9'a of the gear drive shaft 9' (e.g. with the aid of an adjusting spring 25) and is located coaxially inside the inner gear ring 16' and at the level thereof, as well as at least two planet wheels 17' arranged in the annular space between the sun wheel and the inner gear ring and in toothed engagement with the latter two.

In this case the gear drive shaft 9' is mounted on the one hand inside the lower hub 24 (below the sun wheel 15') by means of roller bearings 26 and on the other hand at its upper end 9'a (above the sun wheel 15') in further roller bearings 27 centrally inside the upper hub 28 of the upper stirrer 12' so as to be freely rotatable in each case. This upper hub 28 is of cap-like construction and constitutes an upper, straight, approximately cylindrical extension of the lower hub 24, and is independently rotatable with respect to the latter. This upper hub 28 which is closed towards the top has an outer annular space in which roller bearings 29 for freely rotatable mounting and support of the upwardly projecting axial extensions 17'*a* of the planet wheels 17' are mounted. In this way the cap-like upper hub 28 also forms the planet carrier of this planetary gear 10'; in addition, the upper end 24*a* of the lower hub 24 and the upper hub 28 referred to above surround the essential gear parts of the planetary gear 10' like a housing.

Figure 2:
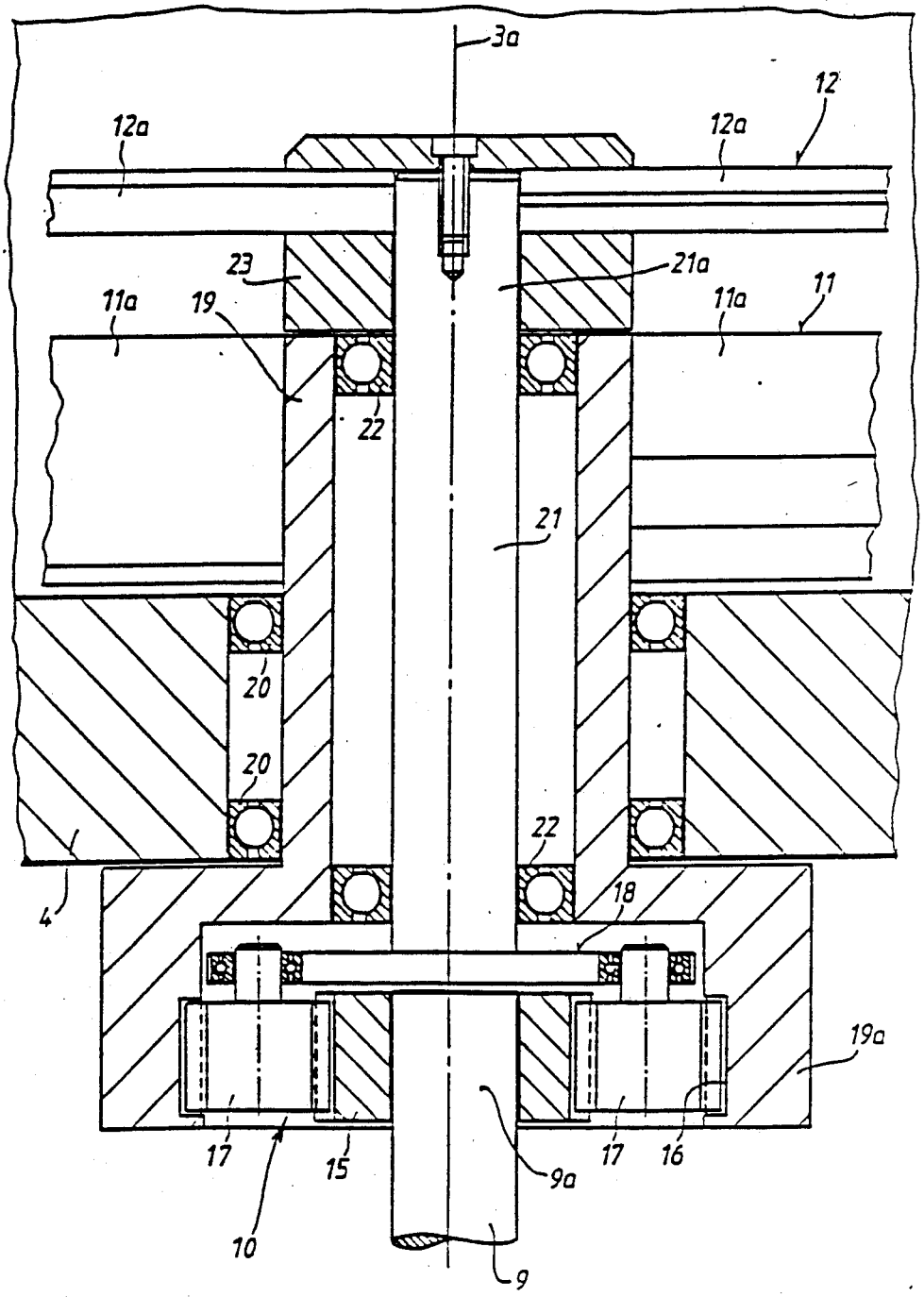
FIG. 2 shows an enlarged sectional view of a detail (corresponding to the section II in FIG. 1) to explain a first embodiment.

As FIGS. 2 and 3 show, the common planetary gear 10 or 10' for the two stirrers is of extremely compact construction and relatively simple design. The planetary gear provides for automatic adaptation of the speed of the two stirrers to the counter-moment occurring at the time. The two stirrers are driven in opposite directions.

If it is assumed, for example, that the planetary gear has a transmission ratio of 1:3 and the gear drive shaft rotates at a speed of 1500 r.p.m., then the maximum speed difference between the two stirrers is 500 r.p.m.

If one assumes that the counter-moment acting on the blades of the lower stirrer is infinitely great, so that the speed of this lower stirrer is zero, then in this case the upper stirrer rotates at a speed of 500 r.p.m. in the same direction as the drive shaft.

In contrast to the embodiments described above, if required the lower stirrer can be the faster-running one and the upper stirrer can be the slower-running one.

A particular advantage of the construction according to the invention from the point of view of process engineering is that because of the automatic adaptation of the speed of the two stirrers to the counter-moment occurring at the time the energy to be used for the mixing operation is introduced into the material to be mixed particularly evenly and without localised overheating. On the other hand, in known constructions the lower stirrers which are located near the base and constructed with a large stirrer cross-section frequently run too fast in comparison with the upper stirrer.

If in the embodiments described above the drive shaft of the planetary gear is introduced into the mixing vessel through the base, it is of course also possible within the scope of the invention to introduce the drive shaft into the mixing vessel through the lid.

Figure 4:
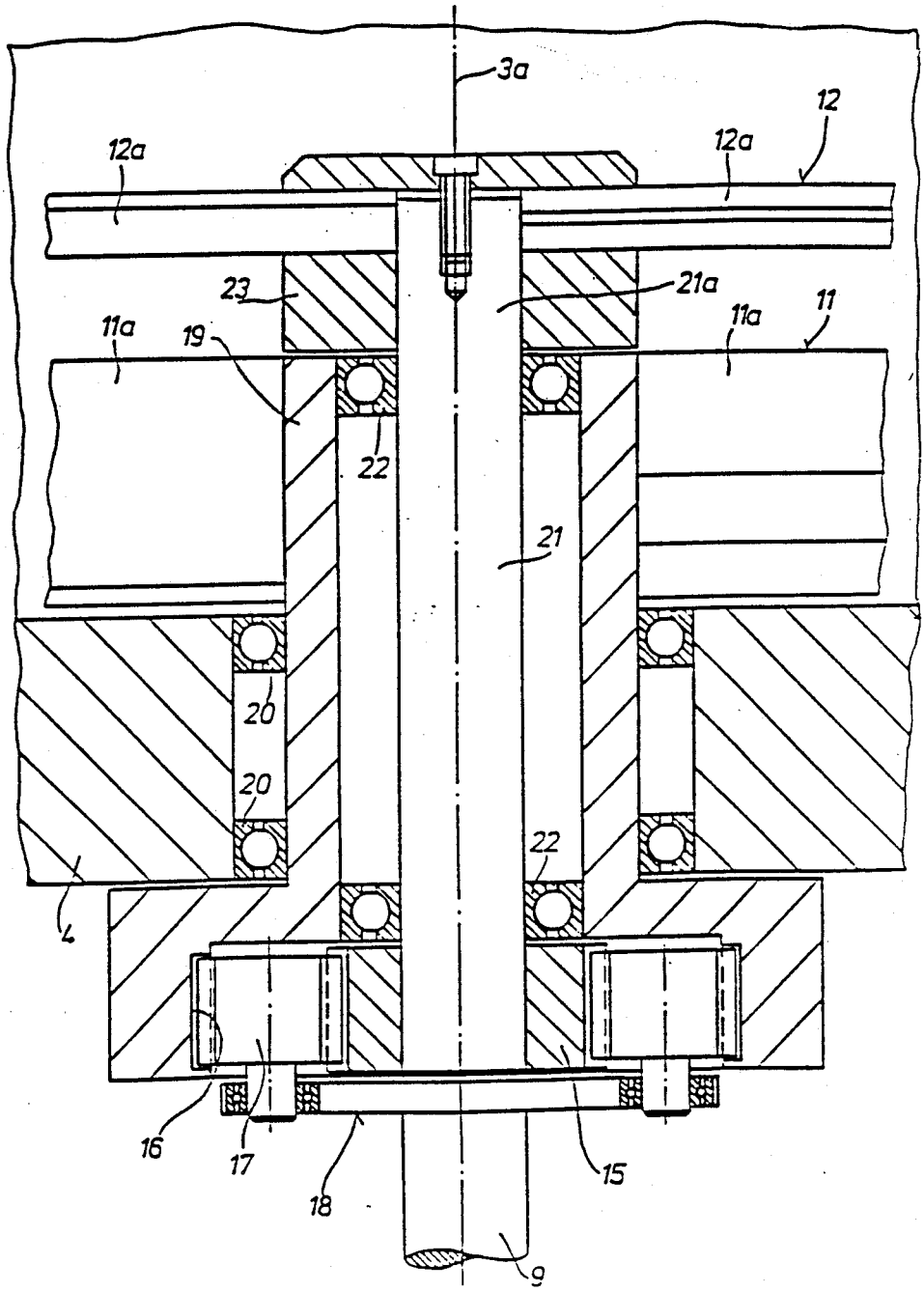
FIG. 4 shows a variant (similar to FIG. 2) of a further embodiment.

Whereas in the embodiments illustrated in FIGS. 1 to 3 the gear drive shaft 9 is coupled to the sun wheel 15 or 15' of the planetary gear, FIG. 4 shows a variant in which the gear drive shaft 9 is coupled to the planet carrier 18 whilst the sun wheel 15 is connected to the upper stirrer 12 via the shaft 21 and the inner gear ring 16 is provided on the hub 19 of the lower stirrer 11. In this embodiment the two stirrers 11 and 12 are driven in the same direction. Here, too, there is an automatic adaptation of the speed of the two stirrers to the counter-moment acting on the stirrer in question.

Figure 5:
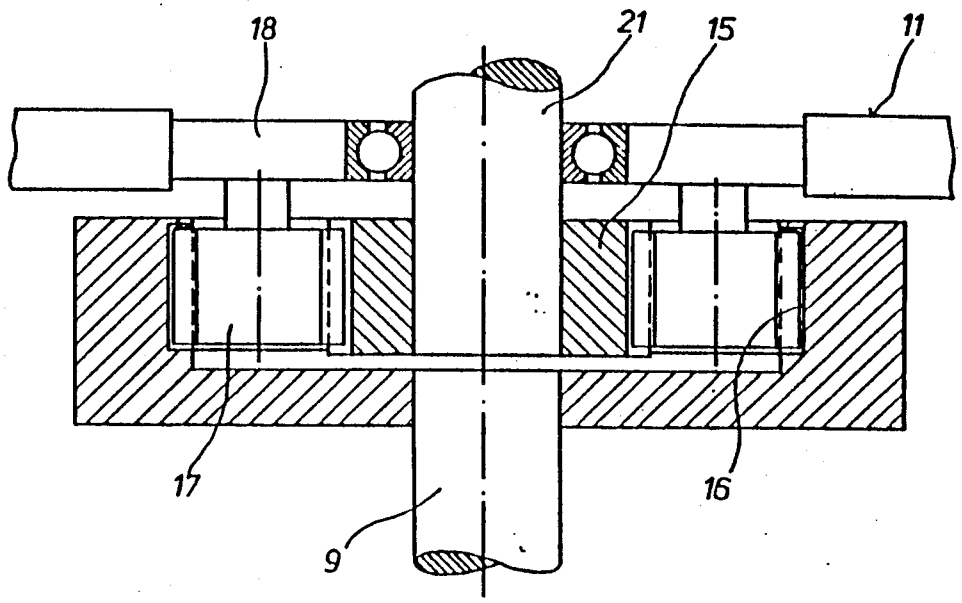
FIG. 5 shows a partial representation of a further embodiment.

Finally, FIG. 5 shows a variant in which the gear drive shaft 9 carried the inner gear ring 16 of the planetary gear, the sun wheel 15 of which is connected via the shaft 21 to the upper stirrer 12 (not shown) and its planet carrier 18 is connected to the lower stirrer. In this construction, too, the speeds of the mixing tools alter as a function of the prevailing counter-moments.

I claim:

1. Mixing apparatus comprising a mixing vessel for containing a quantity to material to be mixed; at least two stirrers; means mounting said stirrers within said vessel for rotation about a common axis; common drive means for said stirrers; and drive transmission means coupling said drive means to said stirrers, said transmission means comprising planetary gear means having a rotary sun gear member, a rotary ring gear member, and a rotary carrier member carrying rotary planet gears in mesh with the sun gear member and the ring gear member, means coupling said drive means to one of said members, means connecting one of said stirrers to another of said rotary members, and means connecting the other of said stirrers to the remaining one of said members, said transmission means being responsive to the resistance imposed by material in said vessel to the rotation of the respective stirrers to adjust the speeds of rotation of said stirrers so that the stirrer encountering the least resistance rotates at the fastest speed.

2. Apparatus according to claim 1 wherein said drive means is connected to said sun gear member.

3. Apparatus according to claim 1, wherein said drive means is connected to said planet gear carrier member.

4. Apparatus according to claim 1 wherein said drive means is connected to said ring gear member.

5. Apparatus according to claim 1 wherein said stirrers have different diameters, the diameter of one of said stirrers being greater than that of the other of said stirrers.

6. Apparatus according to claim 1 wherein said stirrers have different cross-sectional dimensions, the cross-sectional dimension of one of said stirrers being greater than that of the other of said stirrers.

7. Apparatus according to claim 1 wherein one of said stirrers has a hollow hub at one end of which is fixed said ring gear member, and a shaft extending through said hub, said shaft being connected to said planet gear carrier member and to the other of said stirrers.

8. Apparatus according to claim 7 wherein said hub acommodates therein at one end thereof said sun gear member, said planet gear, and said planet gear carrier member.

9. Apparatus according to claim 8 wherein said one end of said hub forms a bell-shaped housing.

10. Apparatus according to claim 1 wherein said coupling means comprises a drive shaft connected to said drive means, a first hub rotatably accommodating said drive shaft, a second hub extending in axial prolongation of said first hub, said sun gear member being fixed to said drive shaft, said ring gear member being fixed to said first hub, and said carrier member being rotatably mounted in said second hub.

11. Apparatus according to claim 10 wherein one of said stirrers is secured to said first hub and the other of said stirrers is secured to said second hub.

12. Apparatus according to claim 1 wherein each of said stirrers comprises a plurality of blades, the blades of at least one of said stirrers having a streamlined cross-section.

13. Mixing apparatus comprising a vessel adapted to contain a quantity of material to be mixed; at least two stirrers; means mounting said stirrers in said vessel for rotation about a common axis and at a level to engage material therein; common rotary drive means for rotating said stirrers; and planetary gear transmission means coupling said drive means and said stirrers, said planetary gear transmission means being responsive to the resistance imposed by material in said vessel to the rotation of the respective stirrers to adjust the speeds of rotation of said stirrers so that the stirrer encountering the least resistance rotates at the fastest speed.

14. Apparatus according to claim 13 wherein each of said stirrers has blades extending radially from said axis, the blades of one of said stirrers having a greater radius than that of the blades of the other of said stirrers.

15. Apparatus according to claim 13 wherein said planetary gear transmission means has a fixed drive transmission ratio greater than 1:1, thereby establishing a maximum difference between the speeds of rotation of said stirrers.

16. Apparatus according to claim 15 wherein said ratio is 3:1.

17. Apparatus according to claim 13 wherein said planetary gear transmission means comprises a rotary sun gear member, a rotary ring gear member, and a rotary carrier member carrying a plurality of rotary planetary gears in mesh with said sun gear member and said ring gear member.

18. Apparatus according to claim 17 wherein said drive means is coupled to said sun gear member.

19. Apparatus according to claim 17, wherein said drive means is coupled to said planet gear carrier member.

20. Apparatus according to claim 17 wherein said drive means is coupled to said ring gear member.

* * * * *

UNITED STATES PATENT AND TRADEMARK OFFICE

CERTIFICATE OF CORRECTION

PATENT NO. : 4,918,665

DATED : April 17, 1990

INVENTOR(S) : Friedrich W. Herfeld

It is certified that error appears in the above-identified patent and that said Letters Patent is hereby corrected as shown below:

In column 1, line 15, change "spaced" to -- speed --;

In column 4, line 43, change "to" (first occurrence) to -- of --.

Signed and Sealed this Ninth Day of July, 1991

*Attest:*

*Attesting Officer*

HARRY F. MANBECK, JR.

*Commissioner of Patents and Trademarks*